US006758203B1

(12) United States Patent
Wu

(10) Patent No.: US 6,758,203 B1
(45) Date of Patent: Jul. 6, 2004

(54) AUTOMATIC AND CONSECUTIVE TARGET FIRING STRUCTURE

(76) Inventor: Wen-Long Wu, No. 5, Alley 26, Lane 62, Tung-Hsing Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 10/689,713

(22) Filed: Oct. 22, 2003

(51) Int. Cl.[7] ..... F41J 9/18
(52) U.S. Cl. ..... 124/6; 446/38; 446/45
(58) Field of Search ..... 124/6, 16, 81; 446/38, 45, 255

(56) References Cited

U.S. PATENT DOCUMENTS 3,570,467 A * 3/1971 Belokin, Jr. ..... 124/26
4,508,093 A * 4/1985 Bertini ..... 124/1
4,781,642 A * 11/1988 Stanzel ..... 446/38
5,050,575 A * 9/1991 Killion ..... 124/8
5,593,338 A * 1/1997 Itoh et al. ..... 446/259
5,782,228 A * 7/1998 Wu ..... 124/6
5,996,564 A * 12/1999 Kotowski ..... 124/6
6,116,229 A * 9/2000 Wu ..... 124/6

* cited by examiner

*Primary Examiner*—John A. Ricci
(74) *Attorney, Agent, or Firm*—Birch, Stewart, Kolasch & Birch, LLP

(57) ABSTRACT

An automatic and consecutive clay target firing structure includes two driving sources to drive respectively a rotary mechanism and clay targets to rotate, a target feeding unit located on the rotary mechanism having two target barrels located on two sides for housing a plurality of the clay targets, a lifting unit located in the center of the rotary mechanism movable upwards to enable one of the driving sources to couple with the clay target, and a control unit located outside the target feeding unit and transversely connected to the target feeding unit to control flying of the clay targets, and connected through a trigger unit through a circuit so that the clay targets may be fed consecutively into the target feeding unit to be driven by the driving source for rotation, and may be activated to achieve rapid firing and flying to be used in shooting game.

10 Claims, 17 Drawing Sheets

AUTOMATIC AND CONSECUTIVE TARGET FIRING STRUCTURE

FIELD OF THE INVENTION

The present invention relates to an air target firing structure and particularly to an automatic clay target firing structure for consecutively discharging clay targets upwards in the air for use in clay target shooting sport.

BACKGROUND OF THE INVENTION

Conventional clay target shooting sport usually has one person manually firing clay targets in the air to enable another person to shoot the clay targets. The number of clay targets being shot down is counted in the scores of the game. Such an approach cannot provide stable firing time and height for the clay targets. Moreover, with one person taking care of firing the clay targets while another person shooting, the game is dull. It cannot create the excitement of consecutive shooting.

SUMMARY OF THE INVENTION

Therefore the primary object of the invention is to provide an automatic and consecutive target firing structure for consecutively discharging clay targets in the air from varying spots at selected speeds to reach selected heights without skewing to allow one or more person to participate shooting.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
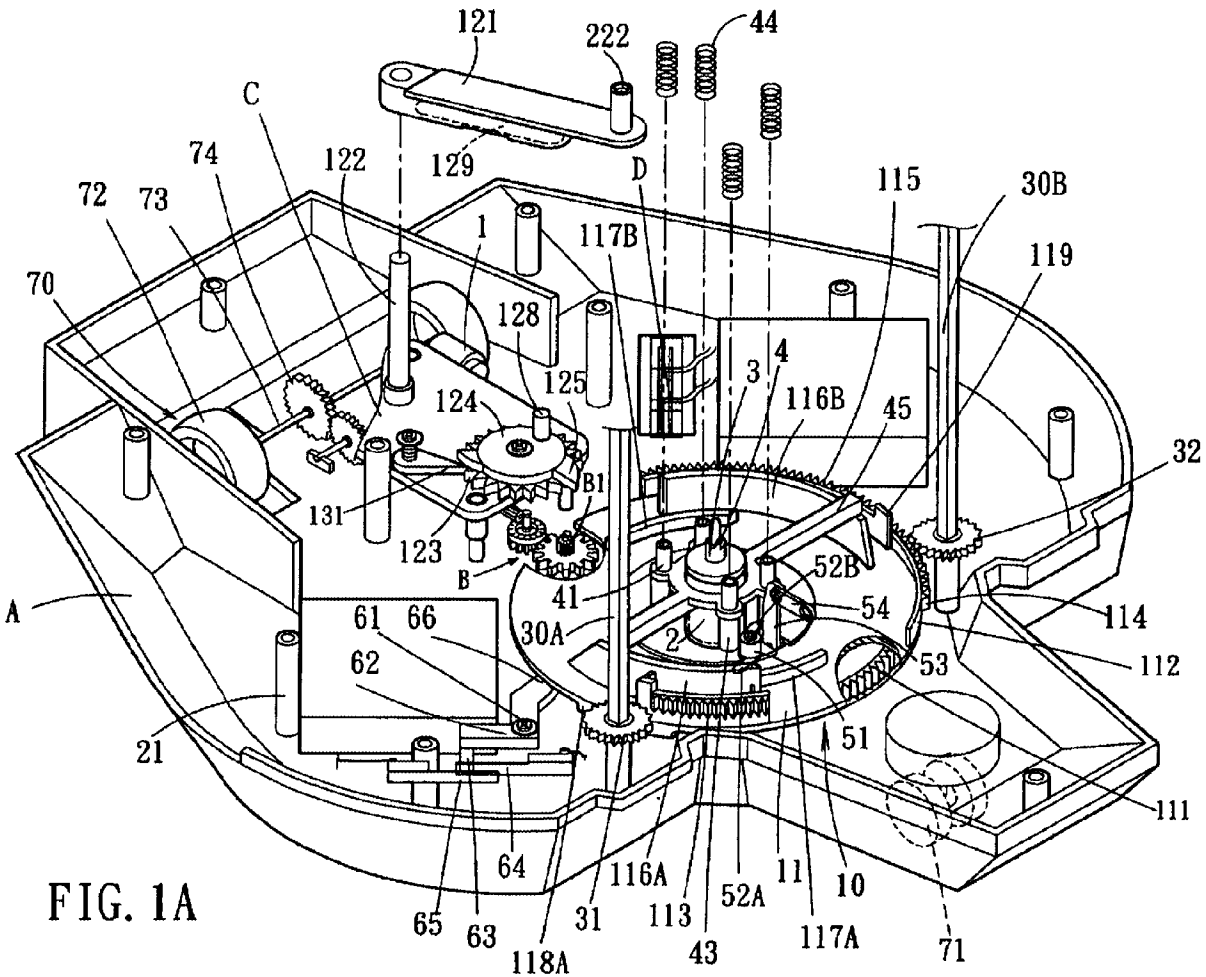
FIGS. 1A and 1B are perspective views of the present invention.
Figure 1B:
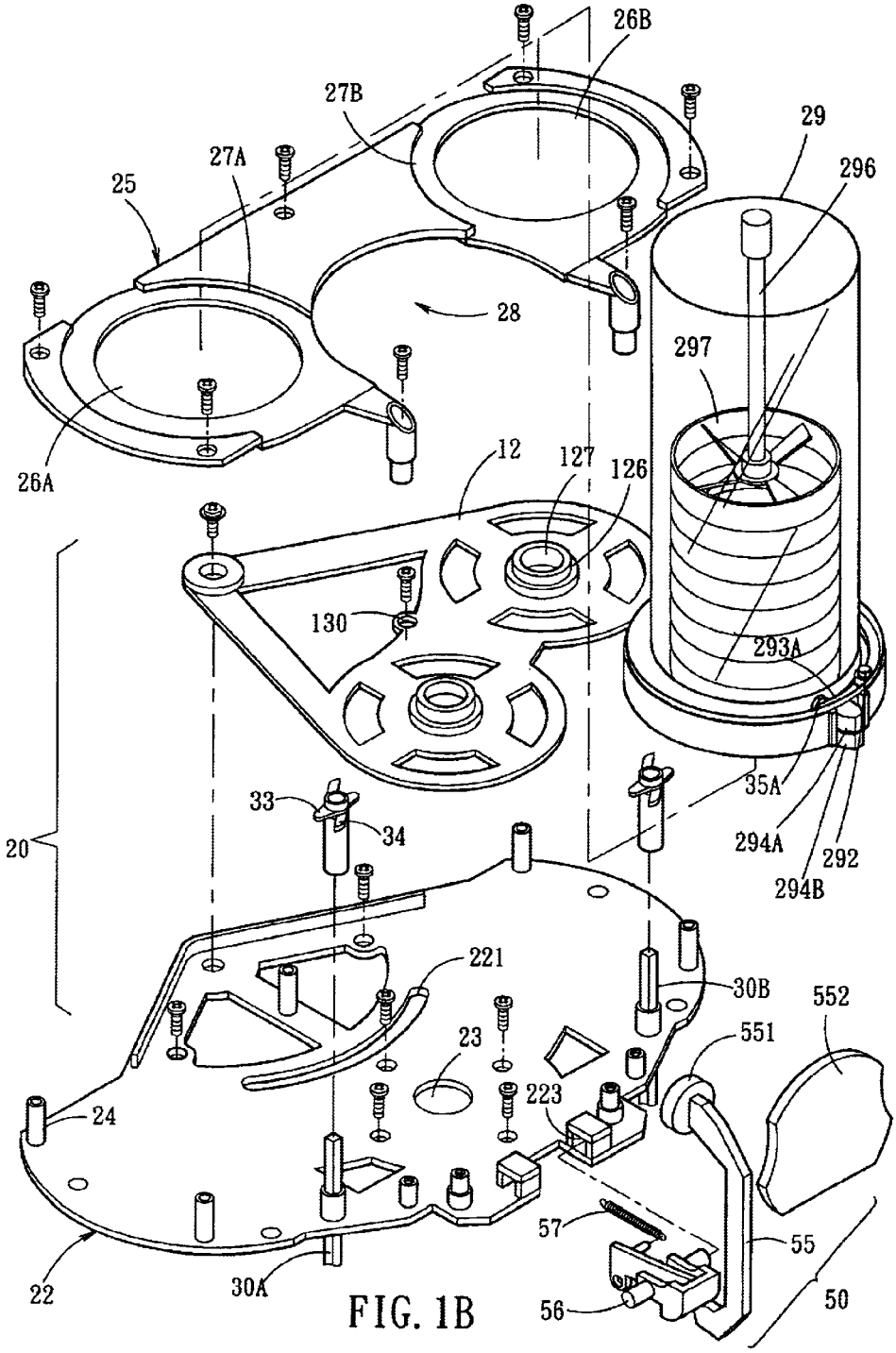
Figure 2:
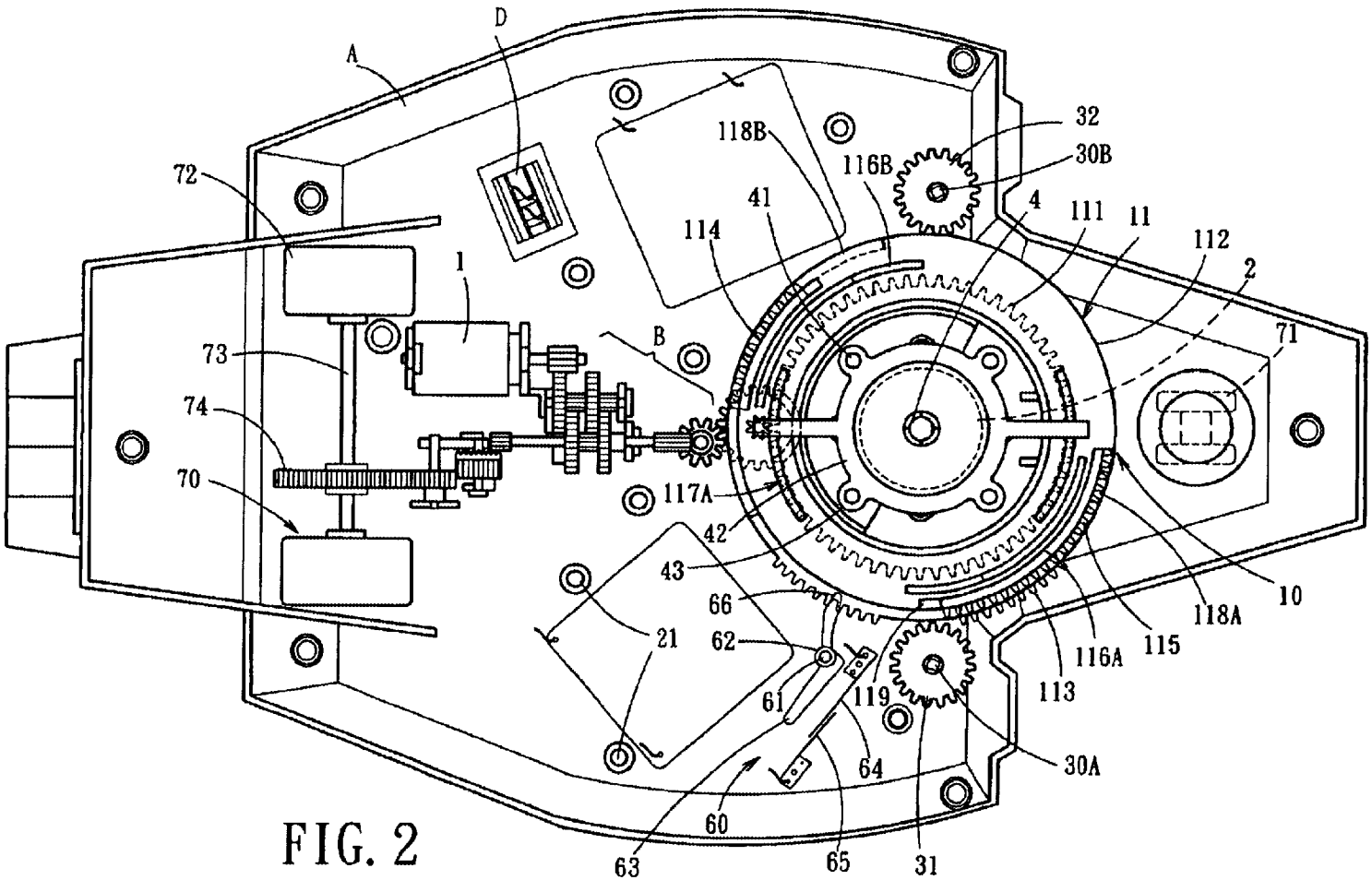
FIG. 2 is a top view of the rotary disk of the present invention.
Figure 3A:
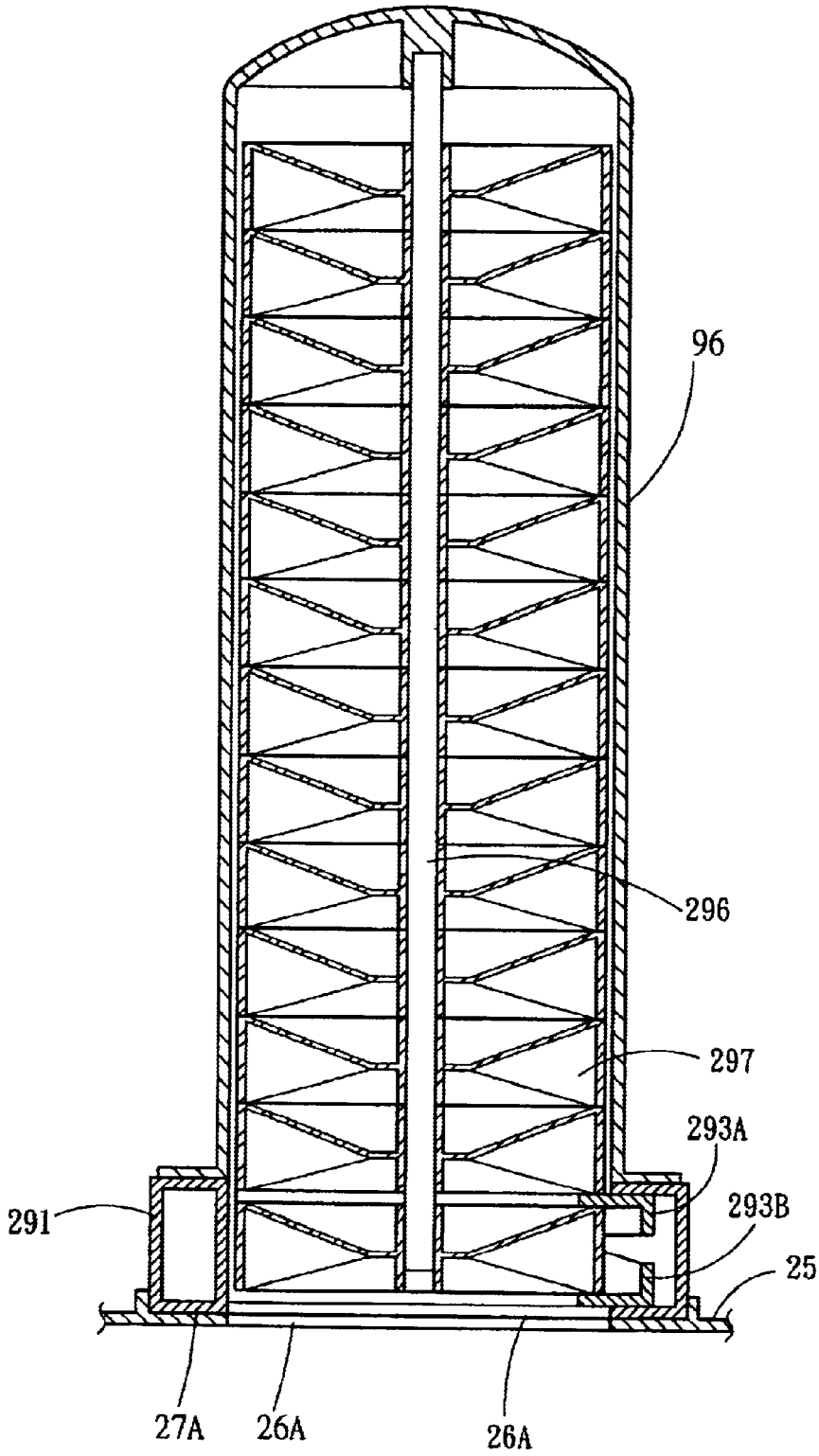
FIGS. 3A, 3B and 3C are sectional views of the target barrel of the present invention.
Figure 3B:
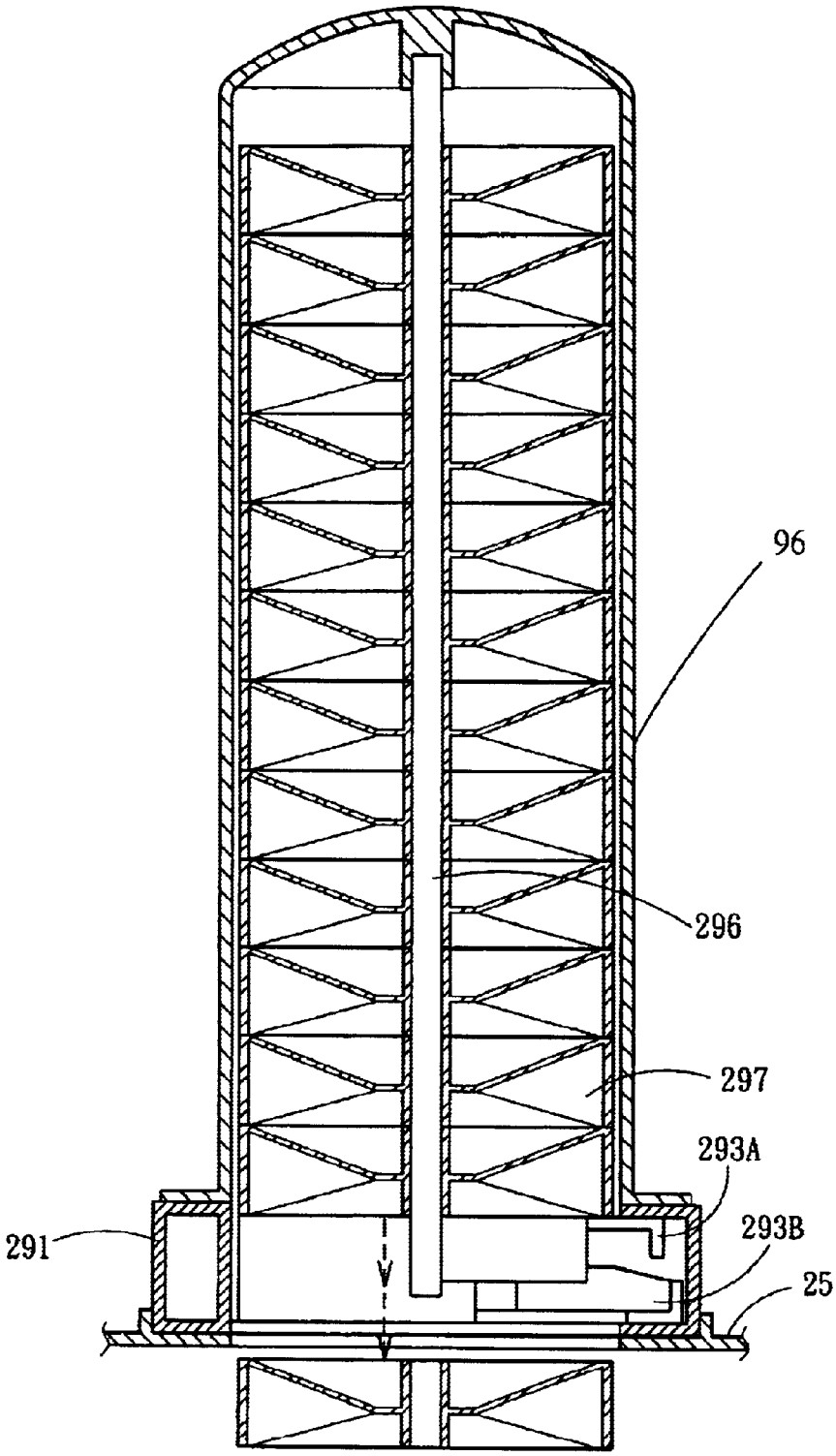
Figure 3C:
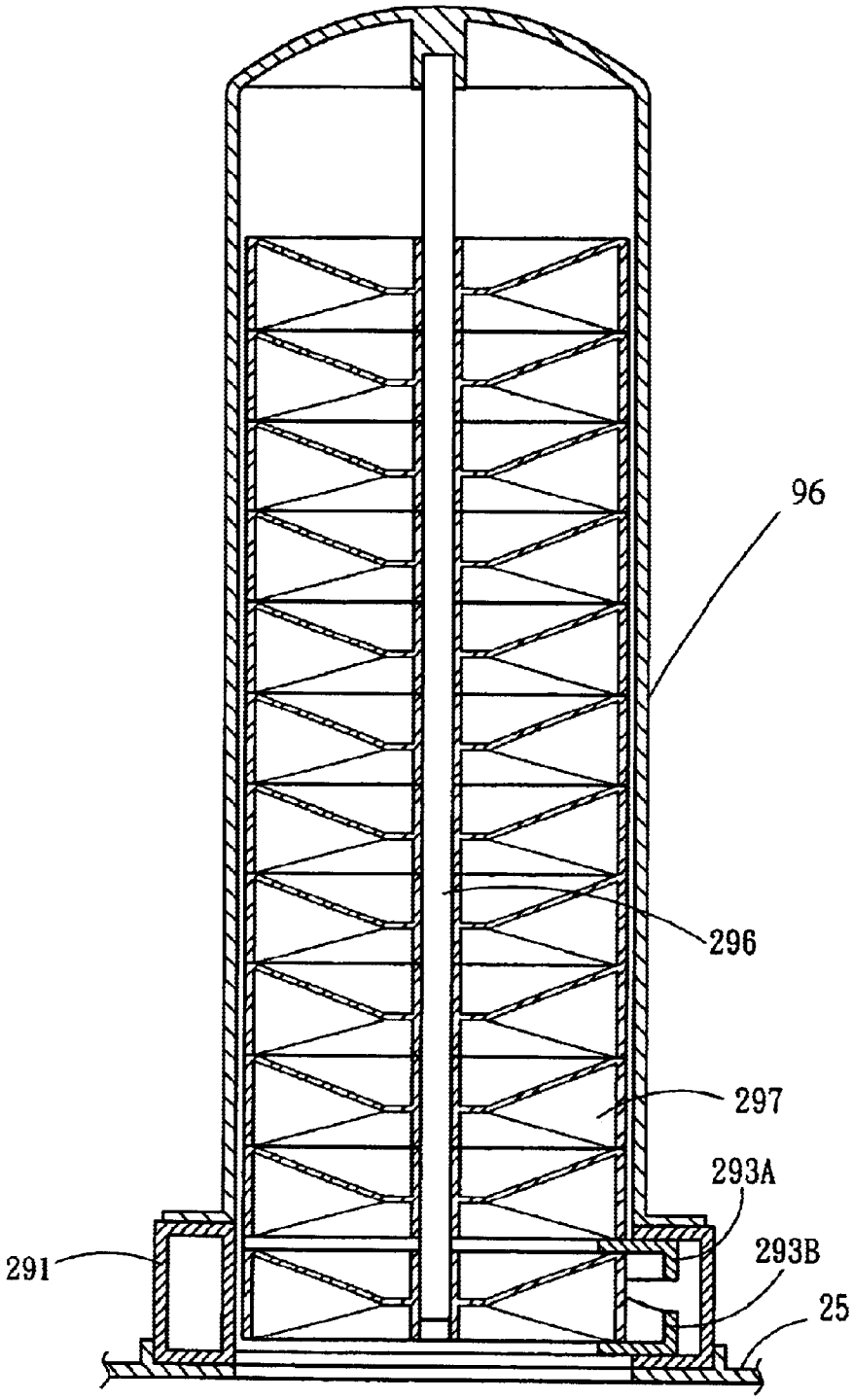
Figure 4:
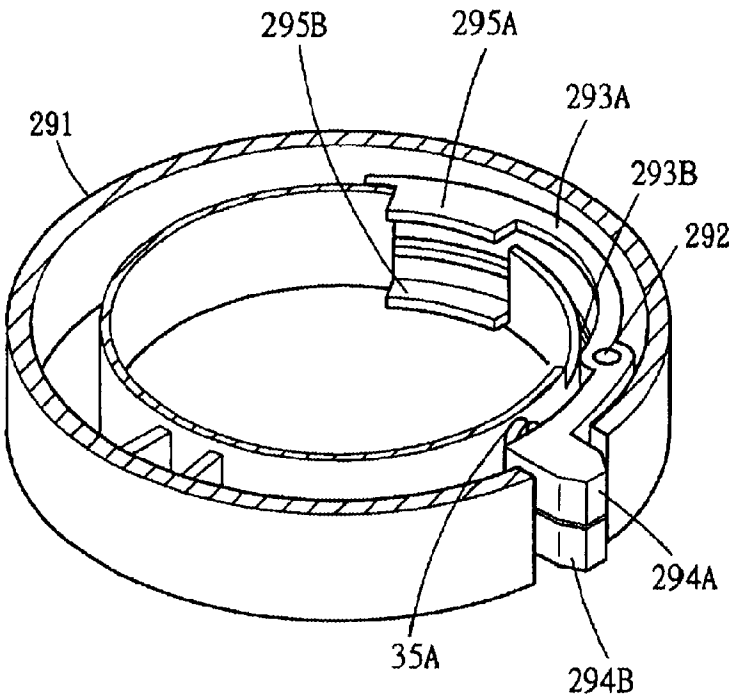
FIG. 4 is a perspective view of the target barrel seat of the invention.
Figure 6:
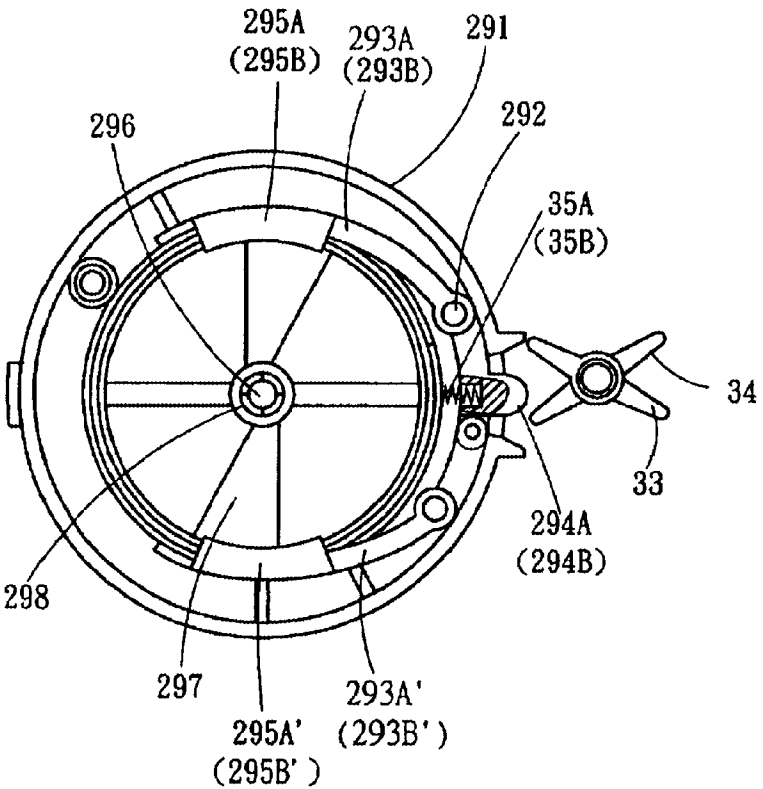
FIG. 6 is a sectional view of a second embodiment of the target barrel seat of the present invention.
Figure 5A:
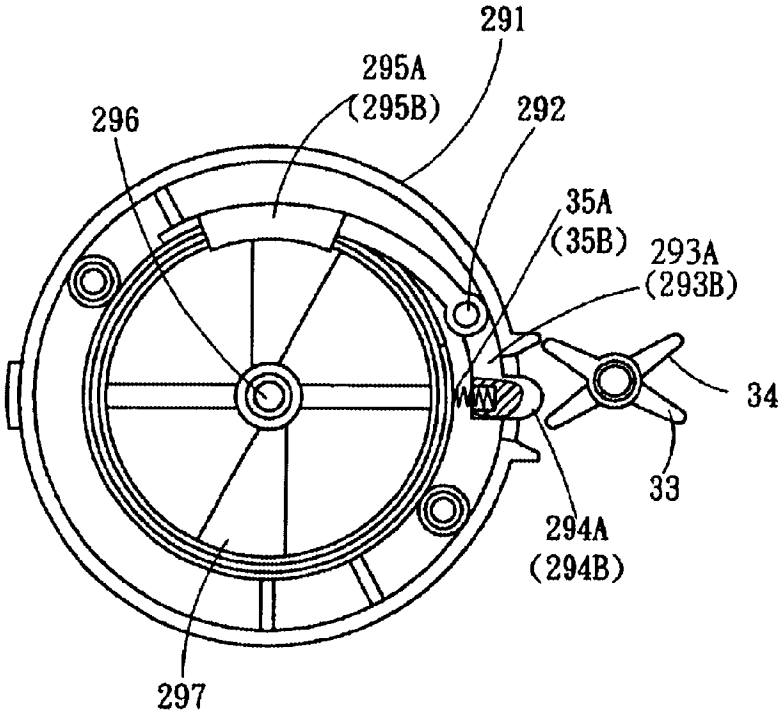
FIGS. 5A and 5B are sectional views of the target barrel seat in operating conditions.
Figure 5B:
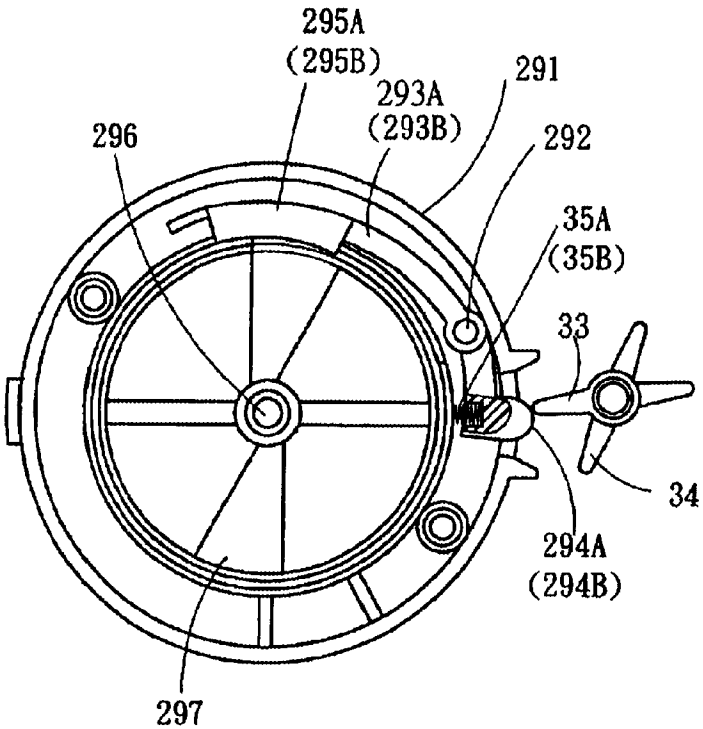
Figure 7A:
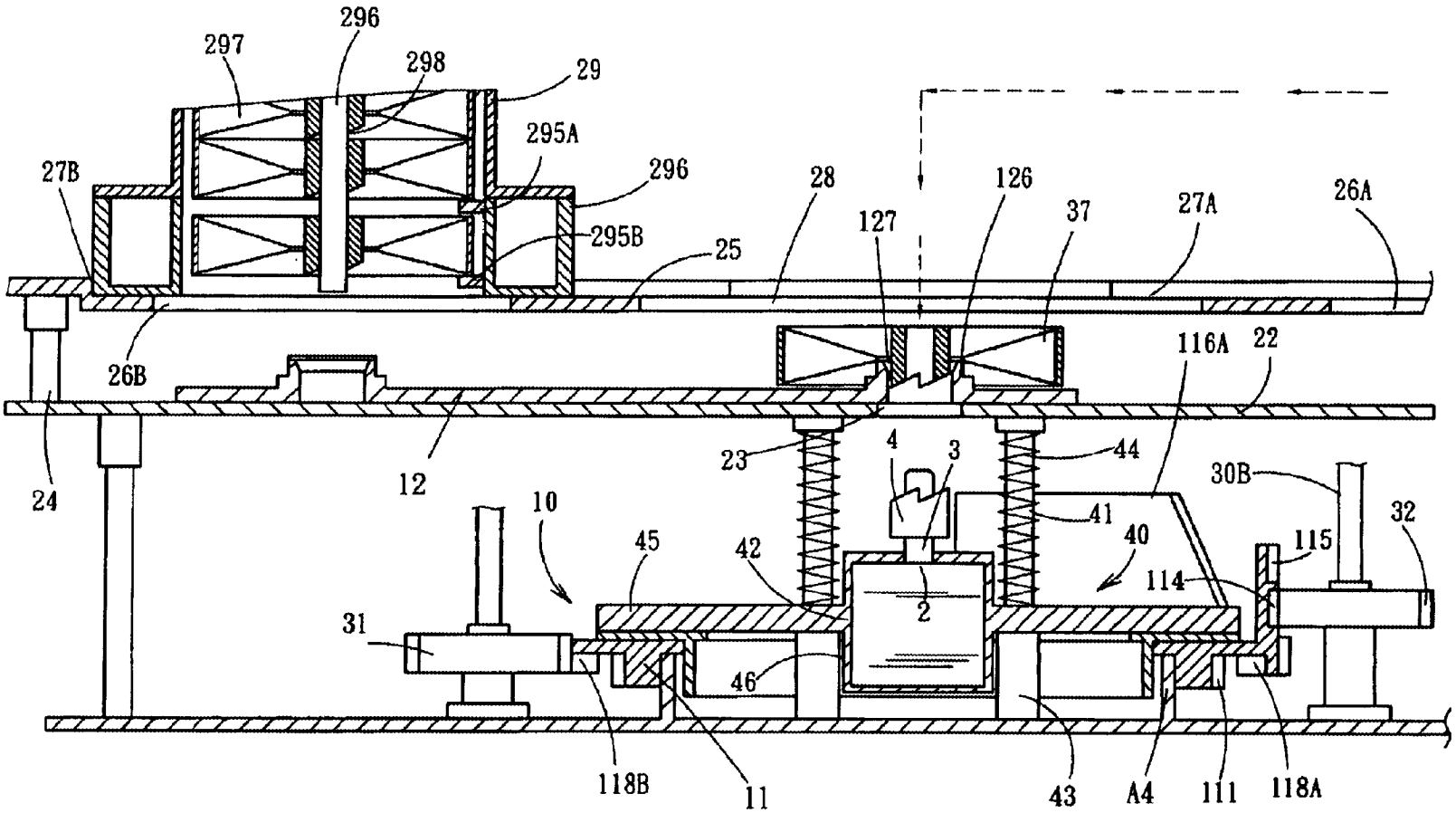
FIGS. 7A, 7B and 7C are schematic views of target feeding operations.
Figure 8A:
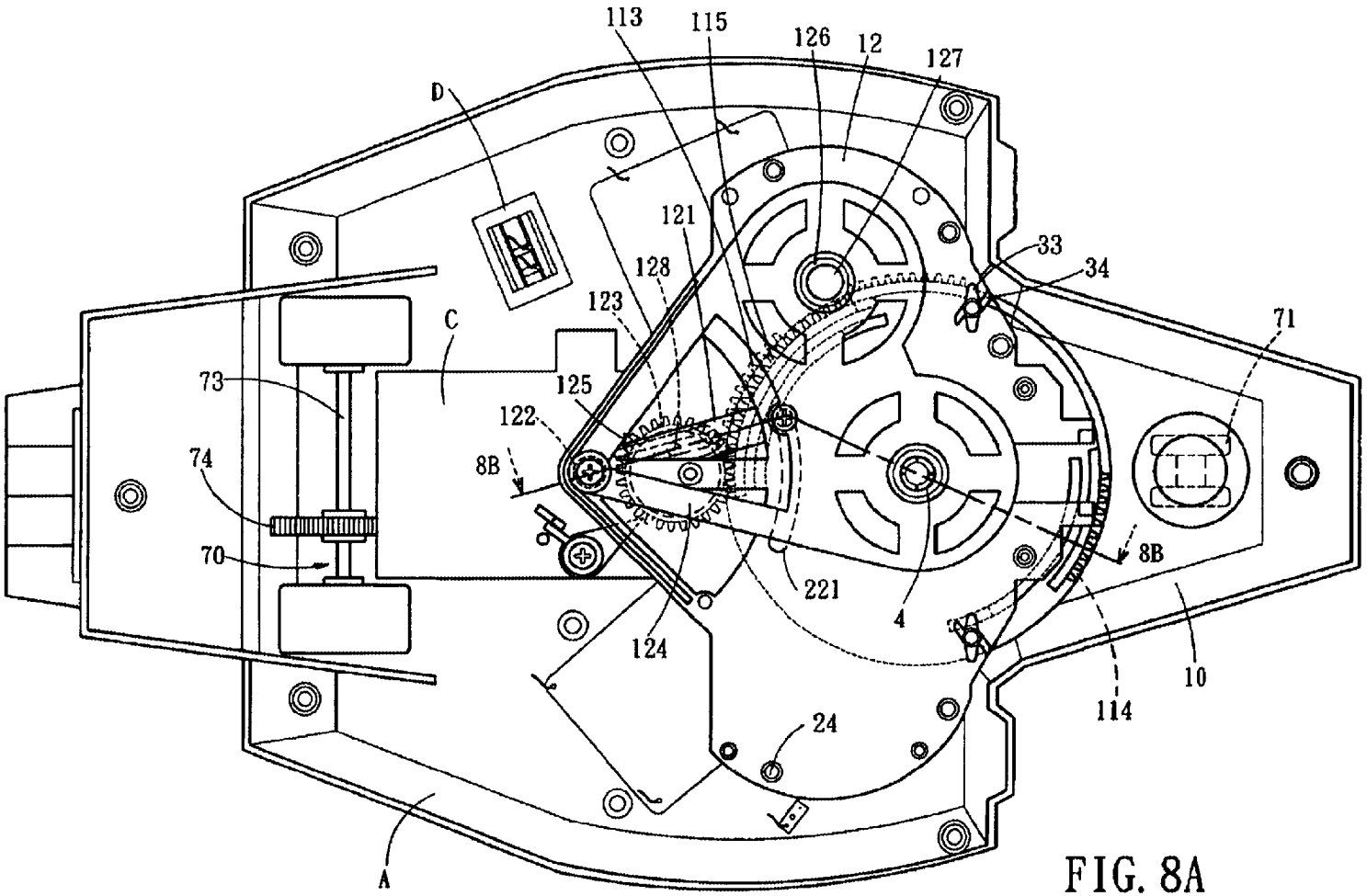
FIG. 8A is a top view of the target feeding unit in an operating condition.
Figure 8B:
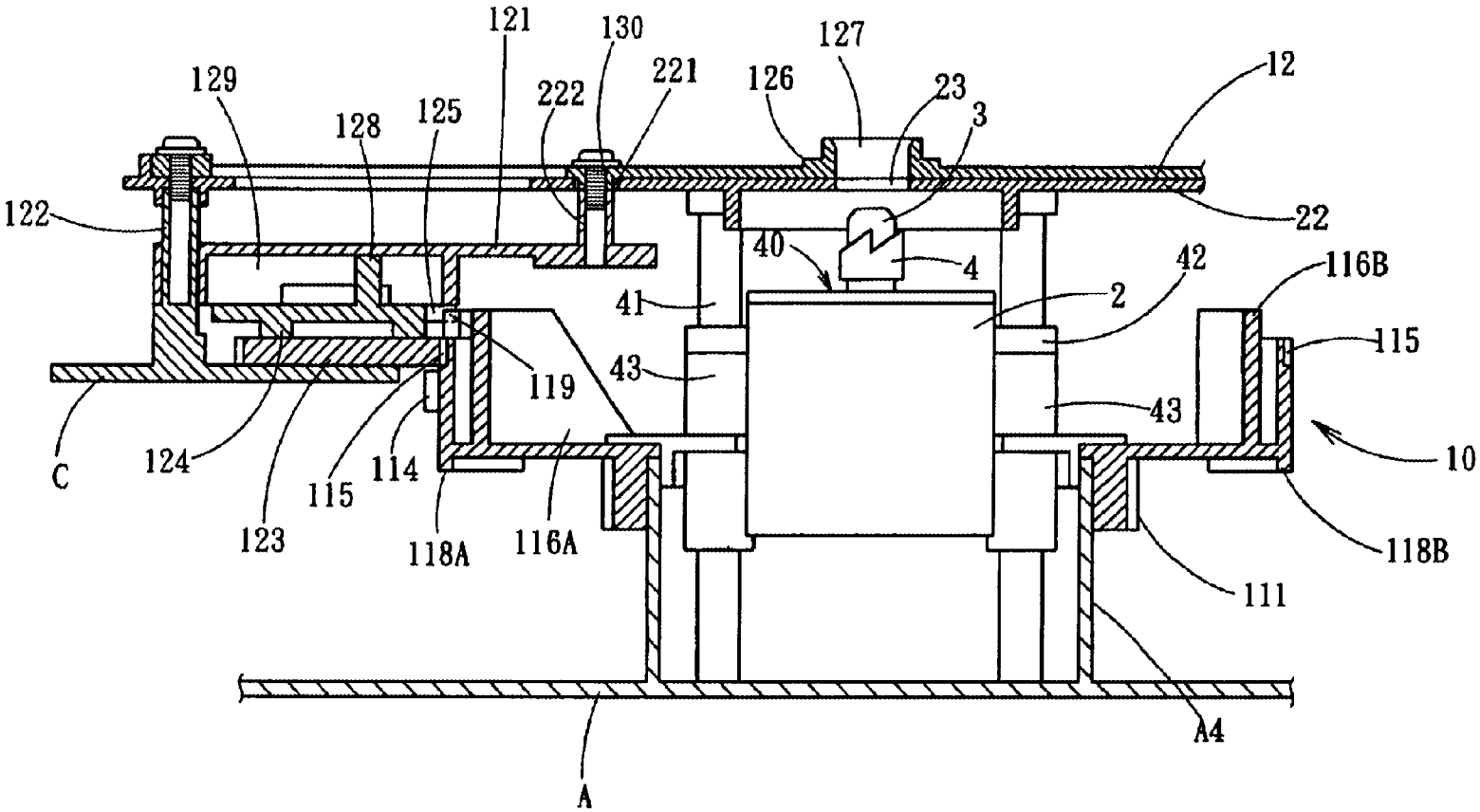
FIG. 8B is a fragmentary cross section taken on line 8B—8B in FIG. 8A.
Figure 8C:
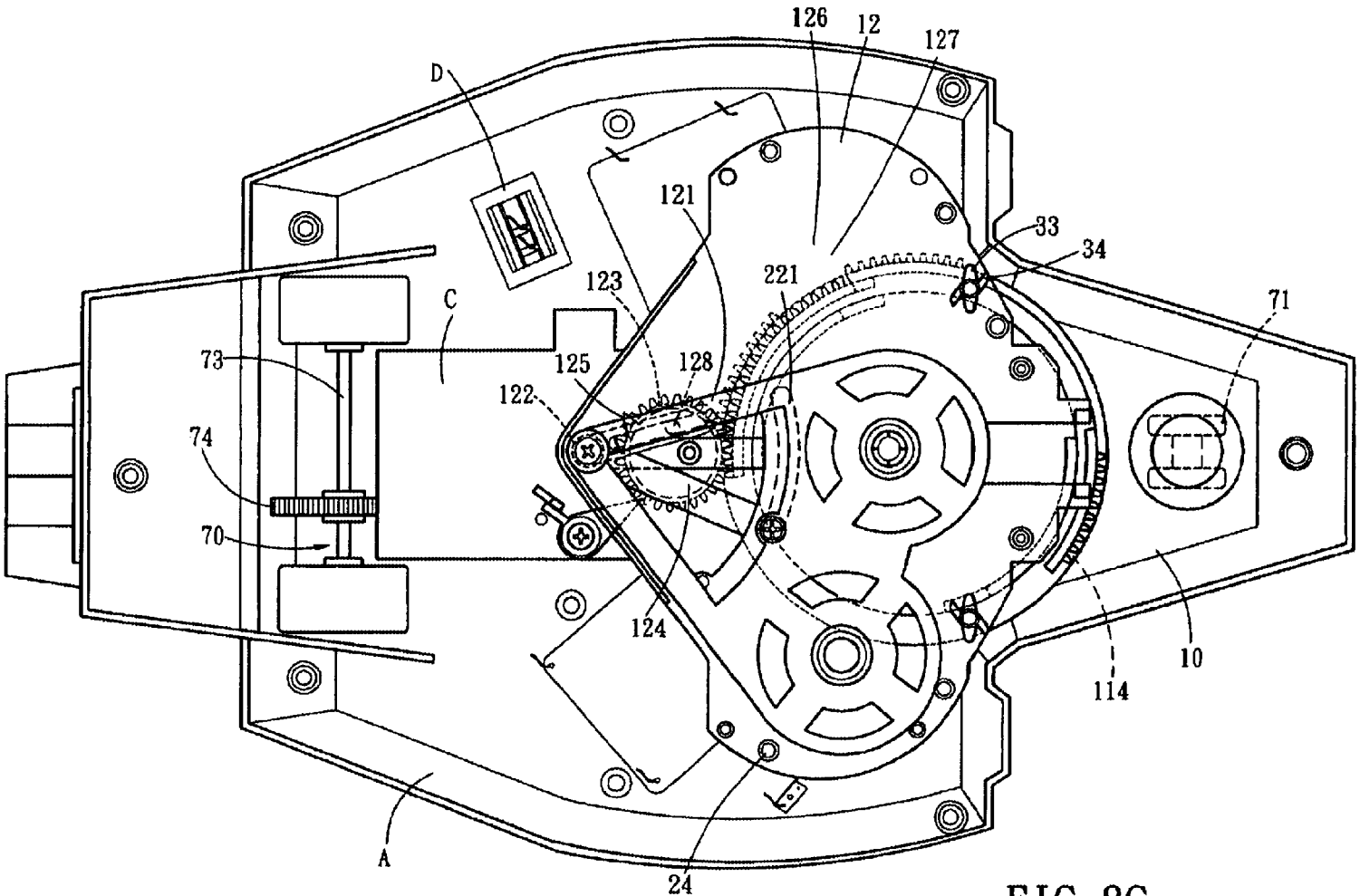
FIG. 8C is a top view of the target feeding unit in another operating condition.
Figure 9A:
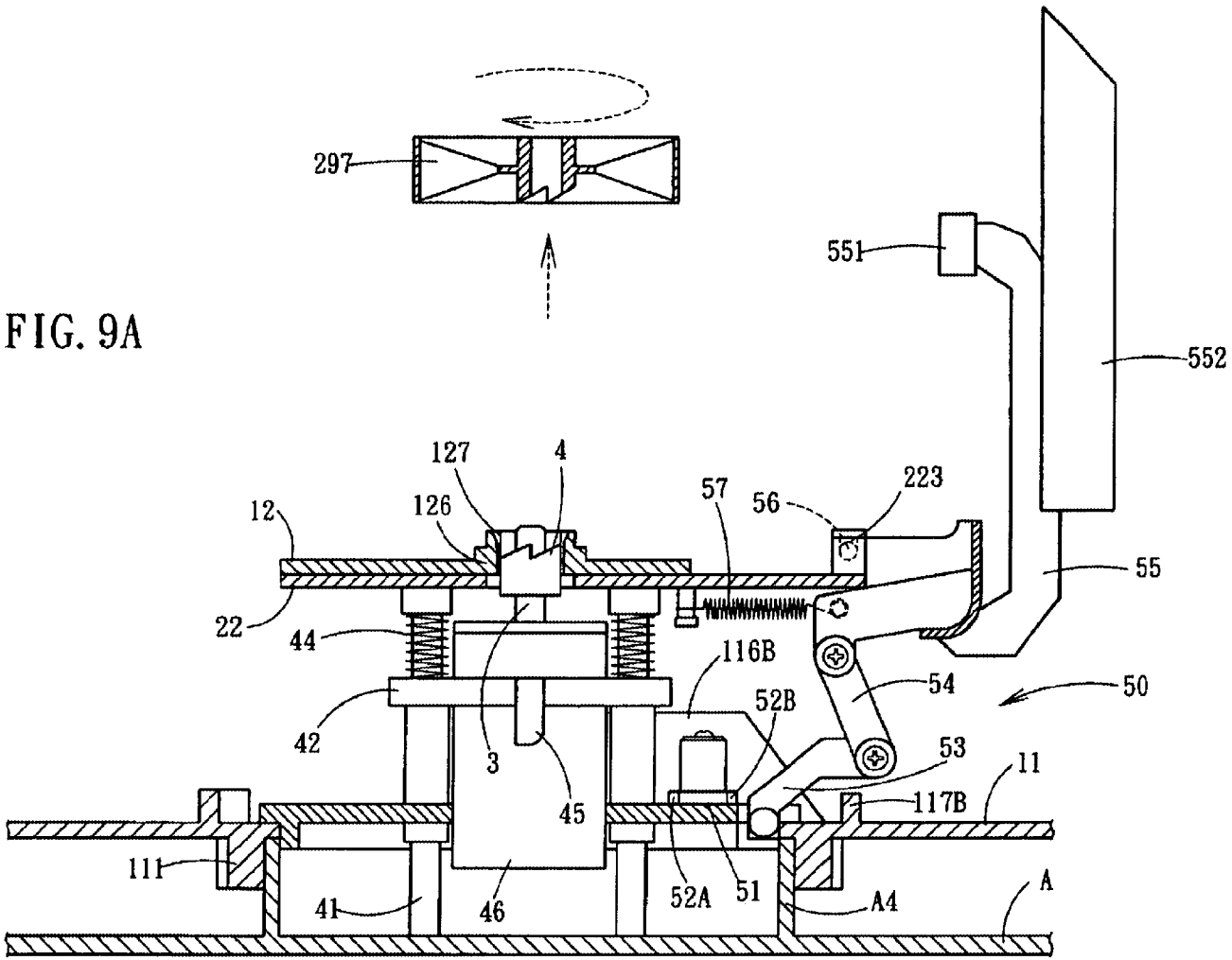
FIGS. 9A and 9B are schematic views of the control unit of the invention in an operating condition.
Figure 9B:
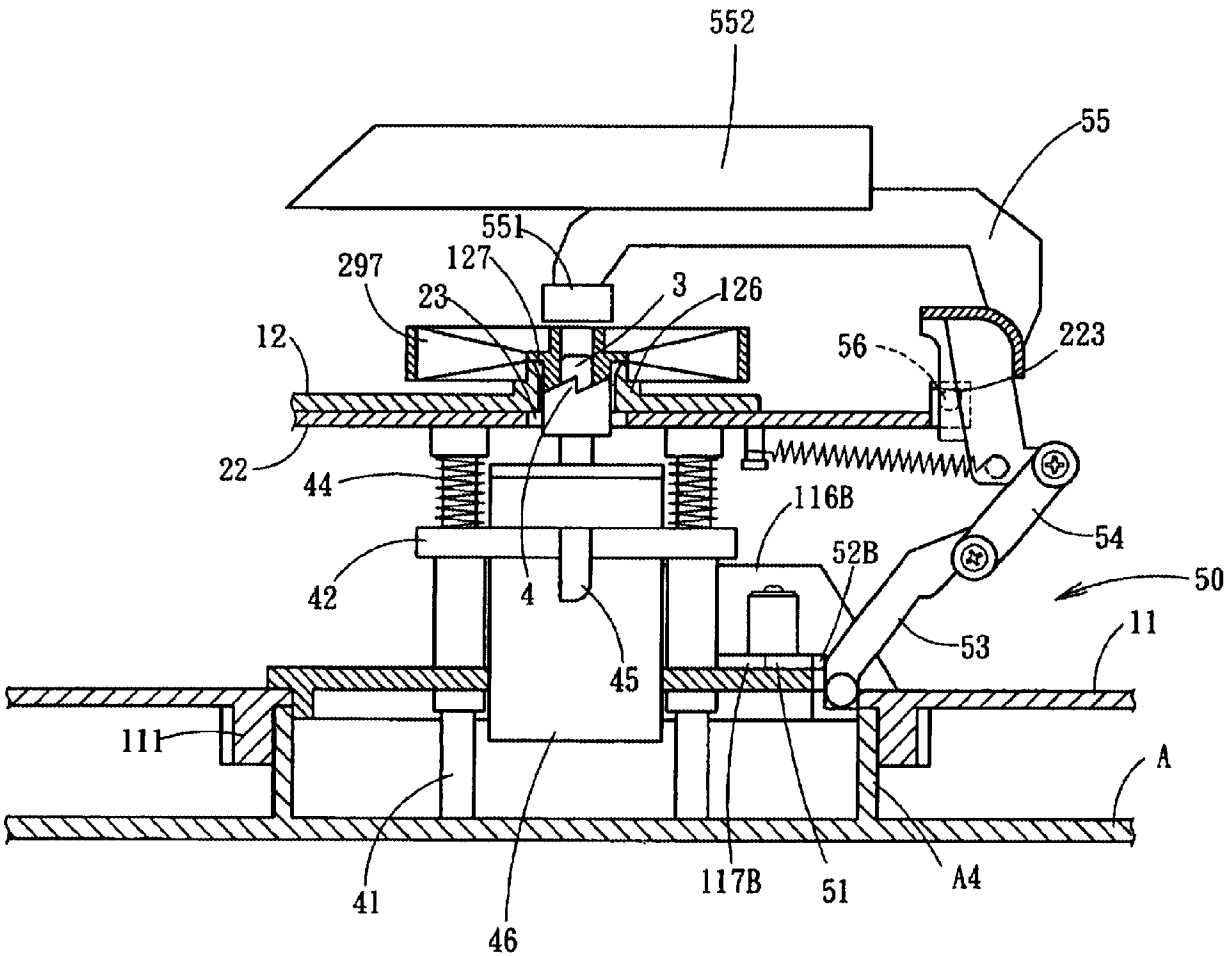

Please referring to FIGS. 1A and 1B, the automatic and consecutive target firing structure according to the invention includes:

a first driving source 1 and a second driving source 2 (such as motors) mounting onto a base dock A. The base dock A has an annular ring A4 extending upwards (also referring to FIG. 7A);

a rotary mechanism 10 (also referring to FIG. 2) which includes a rotary disk 11 located on the periphery of the annular ring A4 of the base dock A and driven by the first driving source 1. The first driving source 1 is engaged with a reduction gear mechanism B which has a pinion B1 at the top end to drive a gear 111 located at the lower side of the rotary disk 11. The rotary disk 11 has a peripheral wall 112 coupling to a first gear rack 113, a second gear rack 114 and a fourth gear rack 115 that are located at different elevations. The top side of the rotary disk 11 has two opposing ramp flanges 116A and 116B which have a sloped top edge directing upwards from a head end. There are two arched actuators 117A and 117B locating at two sides of the top surface of the rotary disk 11 and on the inner side of the ramp flanges 116A and 116B. The bottom of the rotary disk 11 has two bucking sections 118A and 118B. The third gear rack 115 of the rotary disk 11 has a front end extending to form a brake section 119 higher than the third gear rack 115;

a target feeding unit 20 located on the top section of the rotary disk 11 including a plurality of posts 21 mounting on the top surface of the base dock A as shown in FIG. 1A. The posts 21 jointly support a fan-shaped platform 22 as shown in FIG. 1B. The platform 22 has an opening 23 in the center, and struts 24 on the periphery to support a target deck 25. The target deck 25 has respectively an opening 26A and 26B on the left side and right side. The periphery of the openings 26A and 26B have a retaining edge 27A and 27B. In the middle between the openings 26A and 26B, there is a target firing space 28;

two hollow target barrels 29 with an opening facing downwards. Referring to FIGS. 3A and 4, each target barrel has a barrel seat 291 at the bottom for saddling in the retaining edges 27A and 27B. There is a barrel pin 292 located on the outer wall of the barrel seat 291 directing upwards. The barrel pin 292 runs through arched brake levers 293A and 293B located on the upper and lower side. Each of the brake levers 293A and 293B has one end extending outwards to form a lug 294A and 294B, and another end extending inwards to form a bracing plate 295A and 295B. There is a rod 296 connecting to the center of the top end of the target barrel 29 for coupling the center hole of a plurality of clay targets 297. The bottom of the target barrel 29 has an opening with the bottom peripheral wall forming latch teeth 298;

referring to FIGS. 1A and 2, the base dock A has two vertical pillars 30A and 30B located on the left and right side at the front section. The lower side of the pillar 30A is coupled with a first gear 31 which is engaged with the first gear rack 113 on the periphery of the rotary disk 11. The lower side of the pillar 30B is coupled with a second gear 32 which is engaged with the second gear rack 114 of the rotary disk 11. The top ends of the pillars 30A and 30B have respectively a upper wing 33 and a lower wing 34 (as shown in FIG. 1A) that correspond respectively to the two lugs 294A and 294B of the target barrel 29 (as shown in FIGS. 4, 5A and 5B). The two lugs 294A and 294B have an inner space for housing an elastic element 35A and 35B. When the lugs 294A and 294B are compressed by the upper and lower wings 33 and 34, the elastic elements 35A and 35B are compressed to allow the brake levers 293A and 293B to turn about the pivot pin 292. The horizontal bracing plates 295A and 295B at another end of the brake levers 293A and 293B may swivel outwards. When the lugs 294A and 294B are not compressed by the upper and lower wings 33 and 34, the elastic elements 35A and 35B return to make the bracing plates 295A and 295B to move towards the center to hold the bottom end of the next clay target 297;

refer to FIG. 6 for a second embodiment of the target barrel. It is largely constructed like the first barrel 29 depicted before. The main difference is that on another side of the two lugs 294A and 294B there are another brake levers 293A' and 293B' pivotally engaged thereon, and with the two bracing plates 295A and 295A' of the two brake levers 293A and 293A', or the bracing plates 295B and 295B' of the brake levers 293B and 293B' to hold the bottom side of the bottom clay target 297 in the target barrel 29, a stable holding can be achieved;

the rear side of the platform 22 is pivotally coupled with a sway plate 12 which may be moved horizontally to the left and right side. Referring to FIGS. 1A, 1B and 8A, the sway plate 12 is located on the platform 22 which has an arched slot 221 in the middle to allow a strut 222 to pass through. The strut 222 has a top end running through an aperture 130 on the sway plate 12 and to be fastened by a screw. Referring to FIG. 8B, the strut 222 has a bottom end extended from one end of a rocker arm 121 located below the platform 22. The rocker arm 121 has another end pivotally engaged with an anchor strut 122 with the sway plate 12. The anchor strut 122 is extended vertically from a flat plate C which covers the top side of the reduction gear mechanism B as shown in FIG. 2. The surface of the flat plate C is pivotally engaged with a transmission gear 123 and a transmission disk 124. The transmission disk 124 has two disk wings 125 extended from the periphery and driven to rotate by the brake section 119 at the front end of the third gear rack 115. The transmission gear 123 is engaged with the third gear rack 115 of the rotary disk 11 and is driven to rotate. A ratchet gear 131 has one end pivotally engaged with the flat plate C and another end engaged with the transmission gear 123 to control the rotation direction and precision of the transmission gear 123. The sway plate 12 has two axle hubs 126 located on the left and right side of the front section. Each axle hub 126 has an opening 127 to house the annular latch teeth 298 of the clay target 297 as shown in FIG. 7A. The disk wing 125 has a push bar 128 to couple with a flute 129 formed on the bottom of the rocker arm 121 so that the rocker arm 121 may be driven by the push bar 128 to swivel reciprocally about the anchor strut 122 to the left and right side. The strut 222 runs through the slot 221 and the aperture 130 of the sway plate 12 and to be fastened by a screw so that the sway plate 12 may be swayed reciprocally to the left and right side with the strut 222 (referring to FIG. 8C);

a lifting unit 40 (referring to FIGS. 1A and 7A) located in the center of the rotary disk 11 including four vertical struts 41 on the base dock A running through the rotary disk 11 and below the platform 22, and a lifting deck 42 which has four tubes 43 coupling with the vertical struts 41. Each vertical strut 41 has an upper end running through an elastic element 44 (such as spring). The lifting deck 42 has two turning wings 45 on the left side and right side. The turning wings 45 have an outer end with the bottom corresponding to the ramp flanges 116A and 116B. The lifting deck 42 has a shell 46 in the center to house the second driving source 2. The second driving source 2 has a spindle 3 running through the opening 23 of the platform 22. The top end of the spindle 3 is coupled with a teeth section 4 which is engaged with the latch teeth 298 at the bottom of the clay target 297 to drive the clay target 297 to rotate. When the rotary disk 11 rotates to another angle, the two turning wings 45 are separated from the ramp flanges 116A and 116B, the second driving source 2 drops rapidly to move the spindle 3 downwards to disengage from the clay target 297;

a control unit 50 (referring to FIGS. 1A, 1B and 9A) located within the rotary disk 11 including a rotary wing 51 pivotally engaged with the annular ring A4 of the base dock A. The rotary wings 51 has a first end 52A corresponding to the actuators 117A and 117B, and a rocker arm 53 which has a bottom end transversely located in the annular ring A4 of the base dock A in a pivotal manner. The rocker arm 53 has an inner side bucking by a second end 52B of the rotary wing 51, and a top end pivotally coupled with a lower end of a bridging member 54. The bridging member 54 has an upper end pivotally engaged with the bottom end of a control bar 55. The control bar 55 extends to the left and right side to form a rotary shaft 56 which is pivotally coupled in a pivot hole 223 located on the left and right side at the front section of the platform 22. The control bar 55 is substantially a curved arm facing downwards with a distal end pendant to form a pressing end 551. The pressing end 551 faces downwards corresponding to the opening 23 of the platform 22. The control bar 55 is covered by a safety cap 552 from the upper side and is engaged with a restoring spring 57 on an outer side. The restoring spring 57 has another end engaging with the bottom of the platform 22. When the actuator 117A or 117B is turned with the rotary disk 11, the first end 52A of the rotary wing 51 is moved inwards, and the second end 52B is moved outwards to push the rocker arm 53, and the bridging member 54 pivotally connected to the rocker arm 53 is stretched as shown in FIG. 9B, the control bar 55 rotates about the rotary shaft 56 to make the pressing end 551 to move downwards the center of the clay target 297 on the platform 22 to prevent the clay target 297 from being driven by the spindle 3 of the second driving source 2 and flying upwards;

a trigger unit 60 (referring to FIGS. 1A and 2) located out side the rotary disk 11 including a upright strut 61 on the base dock A to pivotally couple with a rotary member 62. The rotary member 62 extends outwards and downwards to form an actuating end 63 which has an outer side coupling with an inner conductive reed 64 and an outer conductive reed 65 to connect to a positive and a negative circuit. The rotary member 62 has a trigger section 66 on an inner side that may be pushed by the bucking members 118A and 118B so that the inner conductive reed 64 and the outer conductive reed 65 are connected to activate the motor of the second driving source 2; and a moving mechanism 70 pivotally connected to a lower side of the base dock A (referring to FIG. 1A) to move the base dock A including a roller 71 pivotally mounted on the bottom of the front section of the base dock A and two wheels 72 located on the left and right sides of the rear section of the base dock A. The two wheels 72 are connected by an axle 73 which is coupled with a driving gear 74 which in turned is engaged with the reduction gear mechanism B so that the wheels 72 may be driven to rotate, and the roller 71 also may be driven to enable the base dock A to rove around.

Figure 10:
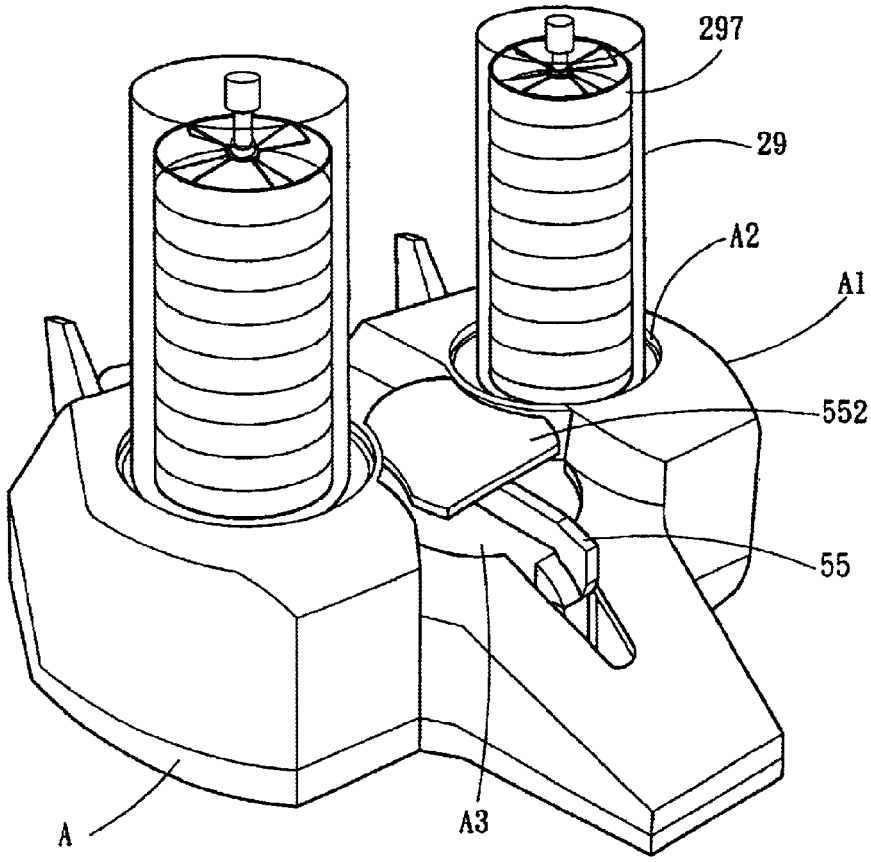
FIG. 10 is a perspective view of the invention.

The base dock A may be covered by a shell cap A1 to form a complete airplane toy model as shown in FIG. 10. The shell cap A1 has two openings A2 on the left and right side to couple with the target barrels 29, and an exit opening A3 in the center to enable the clay target 297 to fly upwards. The first and second driving sources 1 and 2 have a circuit to connect to a power supply battery. Once the first driving source 1 drives the reduction gear mechanism B, the second driving source 2 can directly drives the spindle 3 to rotate the clay target 297, and the circuit is connected from the first driving source 1, through the inner and outer conductive reeds 64 and 65 to activate the second driving source 2 to rotate the spindle 3. The circuit further connects to a circuit start switch D which is located on the bottom of the base dock A to enable users to start manually.

By means of the structure set forth above, referring to FIGS. 1A and 2, when the game starts, trigger the circuit start switch D, the gear 111 at the bottom of the rotary disk 11 is driven by the reduction gear mechanism B and rotates, the first gear rack 113 on the rotary disk 11 is engaged with the first gear 31 of the first pillar 30A, and the first pillar 30A is driven to rotate and drives the upper and lower wings 33 and 34 to rotate synchronously (referring to FIGS. 4A and 4B); the upper wing 33 pushes the lug 294A of the brake lever 293A on the barrel seat 291 inwards, and the bracing plate 295A on another end for holding the clay targets 297 is moved outwards; the clay targets 297 in the target barrel 29 move downwards, the clay target 297 at the bottom is held by the lower bracing plate 295B of the brake lever 293B; when the lower wing 34 of the pillar 30A rotates again, it presses the lug 294B on the outer wall of the barrel seat 291 inwards; the bracing plate 295B moves outwards in the opposite direction to allow the clay target 297 at the bottom to drop on the left side of the sway plate 12 above the platform 22, and the annular latch teeth 298 at the bottom of the clay target 297 couple with the opening 127 of the axle hub 126; when the spindle 3 of the second driving source 2 moves upwards, the teeth section 4 at the upper end of the spindle 3 couples with the annular latch teeth 298 to drive the clay target 297 to rotate (referring to FIGS. 6A, 6B and 6C).

Figure 7B:
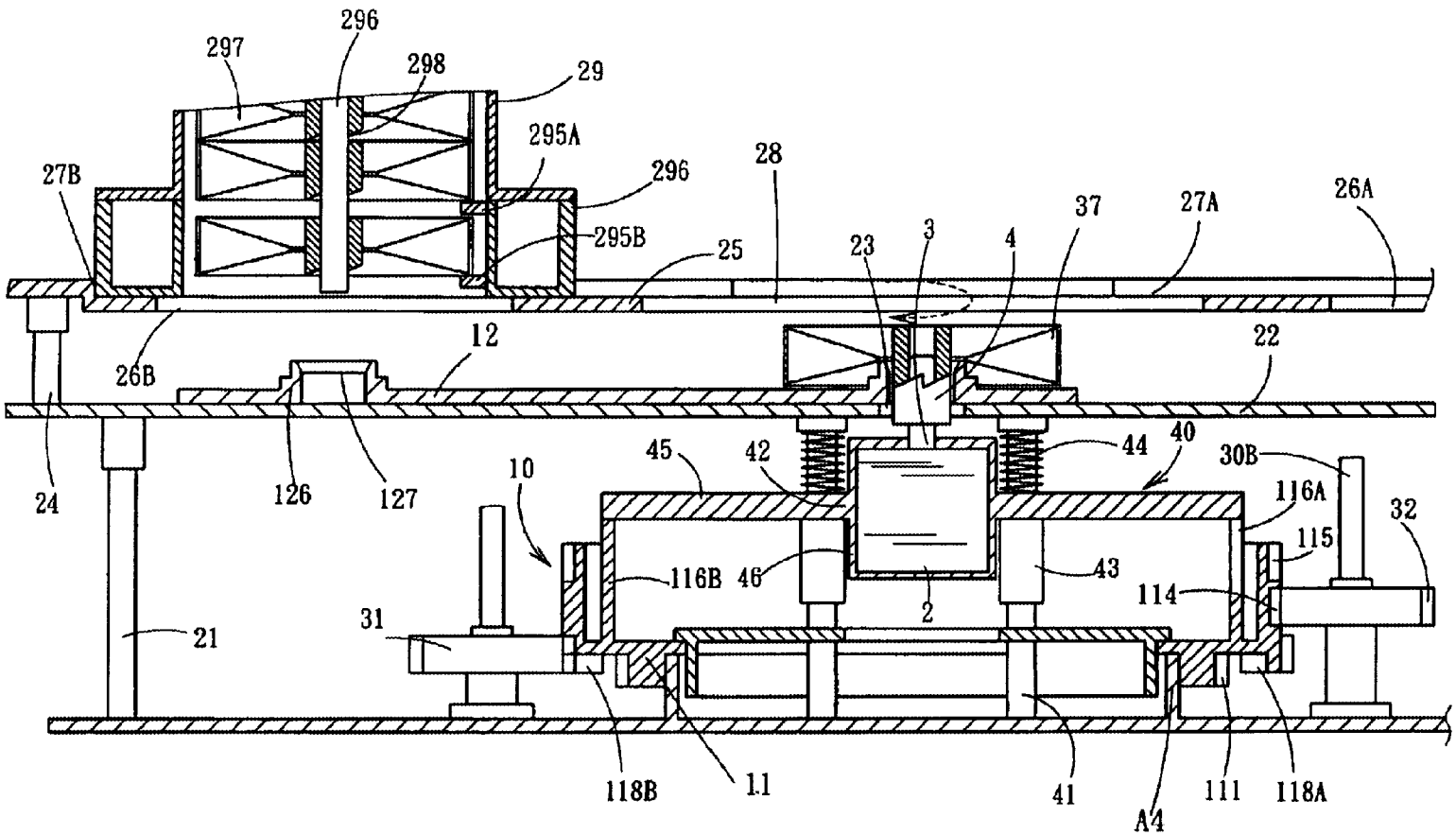
Figure 7C:
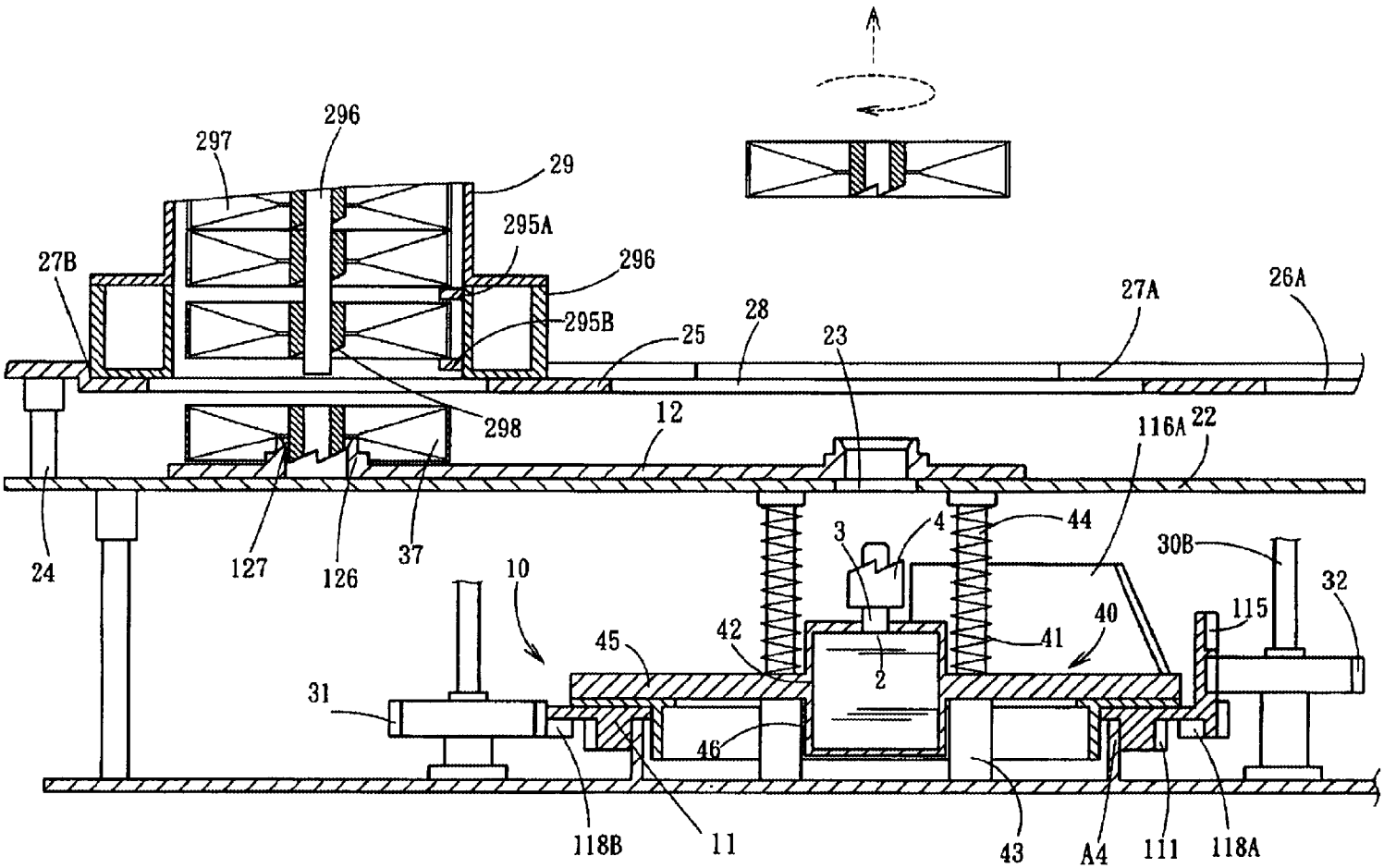

Similarly, when the second gear rack 114 of the rotary disk 11 is engaged with the second gear 32 of the pillar 30B, the upper and lower wings 33 and 34 on the pillars 30B also can control the movement of the brake levers 293A and 203B to allow the clay target 297 at the bottom of the target barrel 29 to drop into the opening 127 of the axle hub 126 at the right side of the sway plate 12; when the sway plate 12 swivels to the right side to hold the clay target 297 from the target barrel at the right side, the axle hub 126 at the left side of the sway plate 12 holds the clay target 297 and is moved to the center of the target firing space 28 (as shown in FIG. 7A) to engage with the spindle 3 of the second driving source 2 and be driven to rotate (as shown in FIG. 7B); the clay target 297 may fly upwards as shown in FIG. 7C; the sway plate 12 then moves to the left side again, and the axle hub 126 at the right side of the sway plate 12 has held the next clay target 297 from the target barrel 29 at the right side and moves to the center of the target firing space 28 of the target deck 25 to wait the lifting spindle 3 of the second driving source 2 to drive and rotate the clay target 297 in the axle hub 126.

As the transmission gear 123 at the lower side of the sway plate 12 is engaged with and driven by the third gear rack 115 of the rotary disk 11, and the transmission disk 124 also is driven to rotate, the push bar 128 at the top section can push the rocker arm 121 to move left and right. The rocker arm 121 is fastened to the sway plate 12 through the strut 222, thus the sway plate 12 also is swiveled left and right. When the strut 222 moves to the left end of the slot 221, the axle hub 126 on the right side of the sway plate 12 carries the clay target 297 to the center of the opening 23 of the platform 22 (referring to FIG. 6A) to be coupled with and driven by the lifting spindle 3 of the second driving source 2. Moreover, in order to control the rocker arm 121 to move to the left and right side at the precise angle so that the sway plate 12 may be swiveled to the left and right side to hold the clay target 297 at the desired time and position, every time the third gear rack 115 is engaged with the transmission gear 123, the brake section 119 at the front end of the third gear rack 115 will first hit the disk wing 125, then calibrate the position of the transmission gear 123 to enable the third gear rack 115 to engage with the transmission gear 123 at the same position every time.

Meanwhile, the two ramp flanges 116A and 116B above the rotary disk 11 are turned to the turning wings 45 at the left and right side of the lifting unit 40 as shown in FIG. 6B, the turning wings 45 are moved upwards along the sloped edge of the ramp flanges 116A and 116B, and the elastic element 44 on the vertical strut 41 is compressed by the lifting tube 43, and the spindle 3 of the second driving source 2 is moved upwards at the same time, the teeth section 4 at the top end of the spindle 3 engages with the latch teeth 298 at the bottom of the clay target 297. Once the teeth section 4 of the spindle 3 is coupled with the latch teeth 298 of the clay target 297, the front end of the bucking member 118A at the bottom of the rotary disk 11 hits the trigger section 66 at the inner side of the rotary member 62 of the trigger unit 60, and the actuating end 63 on the outer side of the rotary member 62 is turned outwards to push the inner conductive reed 64 to contact the outer conductive reed 65 to form a conductive circuit to activate the second driving source 2, and the spindle 3 of the second driving source 2 may rotate rapidly to drive the clay target 297 to rotate and generate a thrust to fly upwards.

Referring to FIG. 8A, before the clay target 297 rotates, the actuator 117A at the top side of the rotary disk 11 is moved by the rotary disk 11 to push the rotary wing 51 of the control unit 50, and the second end 52B of the rotary wing 51 rotates clockwise to press the rocker arm 53 to make its top end moving outwards, the bridging member 54 is turned to move the control bar 55 which is pivotally engaged with the upper end of the bridging member 54 downwards. The pressing end 551 of the control bar 55 is moved above the center of the clay target 297 to prevent the clay target 297 from flying upwards before reaching the full speed to ensure that the clay target 297 can fly to a desired height. It also can prevent the mismatch between the clay target 297 and the spindle 3 of the second driving source 2 to avoid skew flying.

When the actuator 117A is turned away from the first end 52A of the rotary wing 51, the second end 52B of the rotary wing 51 loses thrust power, the restoring spring 57 immediately returns to its original form to pull the control bar 55 to its original position. Once the control bar 55 is moved away from the upper side of the clay target 297, the clay target 297 is freed from the compression and can fly upwards instantly. Before the clay target 297 flies, the rotary disk 11 is turned to move the two ramp flanges 116A and 116B away from the two turning wings 45, the two turning wings 45 and the lifting deck 42 drop rapidly, in the mean time, the tube 43 is pushed downwards by the restoring force of the elastic element 44. Thus the spindle 3 of the second driving source 2 retracts quickly to leave the clay target 297. Such a movement occurs before the control bar 55 bounces to its original position, namely before the clay target 297 flies, so that the clay target 297 may be prevented from being triggered at the moment of flying to achieve a straight flying upwards.

When the opening 127 of the axle hub 126 at the left side of the sway plate 12 carries the lower clay target 297 of the left side target barrel 29 and moves to the center of the opening 23 of the platform 22, the actuator 117B of the rotary disk 11 is turned to the first end 52A of the rotary wing 51 of the control unit 50 to actuate the control bar 55 to move the pressing end 51 above the center of the clay target 297. When the opening 127 of the axle hub 126 on one side of the sway plate 12 is located on the opening 23 in the middle of the platform 22 (as shown in FIG. 6A), the clay target 297 above the opening 127 is driven by the spindle 3 of the second driving source 2 to rotate, meanwhile another opening 127 of the axle hub 126 at another side of the sway plate 12 is located on one side of the target deck 25 to be driven by the turning pillar 30A which turns the lower wing 34 at the top section to drop the next clay target 297. When the preceding clay target 297 is discharged, the sway plate 12 returns and carries the next clay target 297 to the opening 23 of the platform 22 (as shown in FIG. 6C) for waiting the two turning wings 45 to be moved to the top end of the two ramp flanges 116A and 116B of the rotary disk 11, then the spindle 3 of the motor 2 may engage with the latch teeth 298 at the bottom of the clay target 297 to repeat the firing and flying of the next clay target 297.

In order to prevent children from putting hands under the target deck 25 and incidentally trigger the power supply to cause accident, a safety cap 552 may be provided to cover the control bar 55 as shown in FIG. 9 to seal the target firing space 28.

In addition, in order to precisely align the third gear rack 115 with the transmission gear 123, before the transmission gear 123 engages with the third gear rack 115, the brake section 119 at the front end of the third gear rack 115 arrives before hand the disk wing 125 on the outside of the transmission disk 124, and the transmission disk 124 may drive the transmission gear 123 rotating synchronously to achieve precise alignment.

Furthermore, to make the target firing structure of the invention movable, when the first driving source 1 is activated, the two wheels 72 at the lower side of the base dock A are turned at the same time, and the roller 71 also is driven to rotate, therefore the entire base dock A may be moved around to allow the clay targets 297 to be fired at different locations.

In summary, the automatic and consecutive clay target firing structure according to the invention can rapidly discharge a plurality of clay targets 297 upwards continuously for shooting game use. The base dock A also may rove to alter the flying track of the clay targets 297 to increase the fun and amusement of rapid and consecutive shooting.

What is claimed is:

1. An automatic and consecutive target firing structure, comprising:

a base dock formed in a disk shape having an annular ring extending from the top surface thereof;

a first driving source and a second driving source located on said base dock;

a rotary mechanism including a rotary disk mounted onto said annular ring, the rotary disk having a gear at the bottom thereof to be driven by said first driving source through a reduction gear mechanism, a first gear rack, a second gear rack and a third gear rack located on the periphery thereof at varying elevations, two arched and upright ramp flanges opposing each other on said rotary disk that have respectively a sloped top edge directly upwards from a head end thereof, two arched actuators extending from the top side thereof, and two bucking members extending downwards from the periphery of the bottom thereof;

a target feeding unit located on the top section of said rotary mechanism including a platform to support a target deck, said platform having an opening in the center, said target deck having two openings on the left side and the right side for holding respectively a hollow target barrel thereon and a carved out target firing space in the middle, said target barrel having a barrel seat at the bottom that is larger than the periphery of said target barrel, said barrel seat having an outer side pivotally engaged with two horizontal brake levers in up and down manner, each brake lever having one end extending outwards to form a lug and another end extending inwards to form a bracing plate for holding a clay target located at the bottom, each clay target having annular latch teeth on the bottom, said platform having an anchor strut on a rear side to pivotally couple with a rocker arm and a rear end of a sway plate, and being run through by a strut which has a upper end and a lower end coupling with another end of said rocker arm and an aperture of said sway plate, said sway plate having respectively an axle hub extending from the left side and the right side for holding said clay target, said axle hub having a through opening in the center, said rocker arm having a bottom driven by a transmission gear to swivel to the left and right side, said transmission gear being engaged with said third gear rack of said rotary mechanism, said base dock having two vertical pillars on the left side and the right side of a front section to couple respectively at the bottom with a first gear and a second gear that engage respectively with said first gear rack and said second gear rack, each of said pillars have a top section coupling with a upper wing and a lower wing that correspond respectively the lugs of said barrel seat;

a lifting unit located in the center of said rotary disk including a lifting deck which has respectively a turning wing on the left side and the right side, said turning wing having a bottom section corresponding to said ramp flanges of said rotary disk, said lifting deck housing said second driving source which has a spindle running through the through opening of said platform, said spindle having a top section forming a plurality of teeth in an annular manner to engage with said latch teeth at the bottom of said clay target;

a control unit including a rotary wing pivotally engaged with said base dock that has a first end driven by the actuators of said rotary disk to rotate and a second end, and a rocker arm which has a first end transversely connecting to said base dock in a pivotal manner, said rocker arm being pressed by the second end of said rotary wing and having a top end pivotally coupled with a bottom end of a control bar through a bridging member, said control bar having a middle portion pivotally engaged with said platform and a distal end pendent above the through opening of said platform, and a restoring spring which has one end coupling on said control bar and another end coupling on said platform; and a trigger unit located out side said rotary disk including a rotary member pivotally engaged with said base dock, said rotary member having a actuating end on an outer side and a trigger section on an inner side, the actuating end having an outer side coupling with an inner conductive reed and an outer conductive reed to connect to a positive and a negative circuit, said trigger section being pushed by the bucking members of said rotary disk.

2. The automatic and consecutive target firing structure of claim 1, wherein said first and said second driving sources are motors, said base dock having a roller pivotally mounted on the bottom of a front side and a transverse axle on a rear side thereof, said axle having a left side and a right side coupling respectively with a wheel and running through a driving gear which is driven by said reduction gear mechanism, said base dock further having a plurality of posts to hold said platform, said target deck having a retaining edge formed on the periphery of said openings located on the left side and the right side to confine said barrel seat.

3. The automatic and consecutive target firing structure of claim 1, wherein said clay target has an opening in the center, said opening having a peripheral wall which has said latch teeth formed on the bottom side thereof, said target barrel having a upright rod in the center to run through the opening of said clay target.

4. The automatic and consecutive target firing structure of claim 1, wherein said barrel seat has a vertical pivot pin to couple with said two brake levers.

5. The automatic and consecutive target firing structure of claim 1, wherein said transmission gear has a top end pivotally coupling with a transmission disk which has two disk wings on the periphery thereof, said third gear rack having a front end extending to form a brake section higher than said third gear rack, said disk wings corresponding to said brake section, said transmission disk having a push bar extending from the top surface abutting the periphery, said rocker arm having a flute on the bottom to couple with the top end of said push bar and allow the top end to slide therein.

6. The automatic and consecutive target firing structure of claim 1, wherein said platform has an arched slot in the center to allow said strut to pass through and move therein.

7. The automatic and consecutive target firing structure of claim 1, wherein said lifting deck of the lifting unit has four tubes each being coupled with a vertical strut on said platform, said vertical strut being coupled with an elastic element which has an upper end compressing a lower side of said platform and a lower end coupling on said tube, said lifting deck having a shell in the center to house said second driving source of which spindle having said teeth at the top end to engage with said latch teeth at the bottom of said clay target.

8. The automatic and consecutive target firing structure of claim 1, wherein said control bar of the control unit is an arched arm having two ends facing downward and a distal end forming a pressing end, said control bar being covered by a safety cap from above corresponding to said target firing space.

9. The automatic and consecutive target firing structure of claim 1 further having a shell cap covering the base dock to form a toy model, the shell cap having an opening on the left side and the right side for housing said target barrel and an exit opening in the center corresponding to said clay target, said first and said second driving source being connected respectively to a battery, said first driving source being connected to said inner conductive reed and said outer conductive reed through a circuit and a circuit start switch located on said base dock.

10. The automatic and consecutive target firing structure of claim 1, wherein said barrel seat further has another two brake levers on a direction corresponding to said two brake levers to form two pairs of symmetrical brake levers to be pushed by said two lugs.

* * * * *